United States Patent [19]

Arbuthnot

[11] Patent Number: 4,818,122

[45] Date of Patent: Apr. 4, 1989

[54] ACCESSORY DEVICE FOR SAFETY BREATHING EQUIPMENT

[76] Inventor: Robin D. Arbuthnot, Cockles Farm, Morley St. Botolph, Wymondham, Norfolk NR 18 9TW, England

[21] Appl. No.: 86,693

[22] Filed: Aug. 17, 1987

[30] Foreign Application Priority Data

Aug. 16, 1986 [GB] United Kingdom ..... 8620003

[51] Int. Cl.[4] ..... B65D 33/02; B65D 33/08

[52] U.S. Cl. ..... 383/10; 55/DIG. 33; 128/201.25; 383/41; 383/66; 383/103; 383/907

[58] Field of Search ..... 383/907, 103, 10, 41, 383/66; 128/201.25, 202.13; 150/52 R; 55/DIG. 9, DIG. 33

[56] References Cited

U.S. PATENT DOCUMENTS

| | | | |
|---|---|---|---|
| 1,960,232 | 5/1934 | Corbe | 383/907 |
| 2,170,379 | 8/1939 | Ortt | 383/10 |
| 3,172,796 | 3/1965 | Gulker | 383/907 |
| 4,197,841 | 4/1980 | Brauer et al. | 128/202.13 |
| 4,419,110 | 12/1983 | Ansite et al. | 55/DIG. 33 |
| 4,473,072 | 9/1984 | Walther | 128/202.13 |
| 4,583,535 | 4/1986 | Saffo | 128/201.25 |
| 4,669,462 | 6/1987 | Marshall | 128/202.13 |
| 4,685,546 | 8/1987 | Sadow | 383/10 |

*Primary Examiner*—Stephen P. Garbe
*Attorney, Agent, or Firm*—Edwin D. Schindler

[57] ABSTRACT

An accessory device for safety breathing equipment which comprises a generally triangular bag of impervious flexible material tapering downwardly from a wide closed top at which a handle is provided, the bag having a zip-type fastener by which the filter unit of a respirator can be loosely accommodated and supported in a voluminous upper region of the bag equipped with an inlet valve, with a hose which couples to the face mask projecting from the narrow bottom of the bag which tightly surrounds said hose when the bag is closed around the filter unit by means of the zip-type fastener.

6 Claims, 2 Drawing Sheets

ACCESSORY DEVICE FOR SAFETY BREATHING EQUIPMENT

FIELD OF THE INVENTION

This invention relates to an accessory device for safety breathing equipment.

BACKGROUND TO THE INVENTION

When work is being carried out in a toxic atmosphere, for example an atmosphere which is potentially dangerous due to the presence of poisonous gases or fumes, radioactive dust, asbestos dust or the like, it is conventional practice for personnel entering the dangerous environment to put on a respirator in the form of a face mask fed with clean air through a hose or hoses connected to an air filter unit which is also worn, for example by attachment to a waist belt. On entering and leaving the dangerous area, personnel pass through successive decontamination zones, typically including a cubicle for changing into or out of a transit suit, when leaving on the way to a final decontamination zone at which the respirator is removed, showering is carried out, and a further change of clothes is made. Air pumps or air movers are employed to establish a pressure gradient decreasing from downstream to the upstream working area, to assist confinement of contaminant material to the dangerous area being worked. One problem which arises at the showering stage is that, although the face mask would in theory preferably be left on during initial washing, or possibly removed and separately washed, the filter unit has to be kept dry to avoid clogging of the filter and other possible damage. On the other hand, the contaminated filter unit should not be exposed to the clean environment on the far side of the shower cubicle from the dangerous area. In practice, therefore, the respirator is often removed before entering the shower cubicle, and left there in dirty condition for subsequent use. However, this act of removing the face mask outside the shower can cause scattering of dangerous dust and particulates in an area downstream of the primary decontamination zones.

Other problems can also arise in connection with the theoretically preferred practice of not removing the respirator prior to showering, which is an important requirement not only for safety of the personnel involved, but also for the general purpose of confining contaminant material.

Moreover, further problems can arise in handling the respirator with an unclean filter unit downstream of the shower cubicle, i.e. in the nominally clean environment, particularly in view of the fact firstly that the filter unit usually operates from a rechargeable power supply, and recharging may be required prior to future use, and secondly that the used filter elements may have to be replaced by fresh ones.

It is an object of this invention to provide a solution to the above-described problem.

BRIEF SUMMARY OF THE INVENTION

According to the invention, there is provided an accessory device for safety breathing equipment, comprising a bag of flexible impervious material, narrowing from a wide closed top to a relatively narrow bottom end, said bag having means at the top by which it can be carried, a voluminous region below the top for accommodating the air filter unit of a respirator, a region of reducing width below said voluminous region for accommodating the hose or hoses leading towards the face mask of the respirator, and a means of closure extending from the bottom end to a point at or adjacent the closed top and which, when the bag is in use, closes the bag tightly around the hose or hoses extending out of its bottom end and loosely encloses the filter unit in the voluminous region, the arrangement also providing for air access to the interior of the bag for enabling continued operation of the filter unit when required.

One convenient form of closure means may be a zip-type fastener. Since while any dangerous dust is present the respirator can be kept operational, a small negative pressure will exist inside the bag sufficient for preventing contaminant material from exiting through the closure, which may nevertheless permit entry of air for operation of the filter unit. Alternatively, a zip-type closure which effects a seal may be employed, in which case an air entry valve to the bag interior may be incorporated. This valve may be provided in the carrier means, e.g. handle, at the top, the air entry to such an air inlet valve then preferably facing downwardly. In a preferred embodiment, however, an air inlet valve (one-way valve) is provided in the wall of the bag at the voluminous region thereof, the body of said valve being shaped and dimensioned to serve as a spacer which prevents the bag material from being sucked towards the intake of the operational filter unit. It would alternatively be possible to incorporate the air inlet valve and the spacer as separate components.

A suitable material for the bag is an impervious plastics material, for example sheet polyethylene. The bag material may be semi-transparent to facilitate operation of an enclosed filter unit switch.

In the preferred embodiment the bag is generally triangular in shape if flattened, with a straight zip-type fastener adjacent one inclined side edge or on the vertical bisector of one triangular face. The bag is preferably rigidified along its top edge, as by incorporation of a stiffening rod, so as better to retain its shape when being carried from the top with the filter unit supported inside it, at the level below which it is unable to drop further owing to the reducing cross-sectional area of the bag towards the bottom end at which the face mask hose or hoses exit from said bag.

The bag may be provided with one or more external flaps; one such flap may serve to cover the zip-type fastener to prevent entry of water and another may protect the intake to the air inlet valve against entry of water. Alternatively, an externally louvred air inlet valve can serve to prevent entry of water.

In addition to an air inlet valve, if required, the bag may also incorporate an access point for enabling recharging of the power supply of a filter unit housed in the bag.

In another possible arrangement, to assist in ensuring that the filter unit, when operating within the bag, is not choked by drawing the material of the bag on to the filter intake, the bag may also incorporate a support means at or adjacent the bottom of the voluminous region, said support means in use supporting the filter unit so that the weight of the latter does not stretch the bag material in the voluminous region in which said filter unit is accommodated.

USE OF THE INVENTION

The manner of use of the above-described filter unit protection bag will in general be as follows. When personnel leave the dangerous environment, work clothing is removed, except for the respirator, and is vacuum and/or otherwise cleaned as far as possible. The still operating filter unit is then put into the bag, which is zipped up. Leaving the work clothes behind, the user now goes downstream to the shower cubicle. This may involve passage through a transit area which is intended to be kept clean and may be a public area, in which case the personnel may first enter a zone in which a transit suit is put on and also in which the hair may be damped down to minimise scattering of contaminant material. As the operational respirator is kept on and the dirty filter unit is confined in the bag, the user may go downstream to the shower cubicle with minimised risk of scattering dangerous dust, even if passing through a nominally clean transit area. In this connection, it will be appreciated that the continued operation of the respirator causes the maintenance of a small underpressure within the bag, which assists in confining contaminating dust and the like to its interior. Just prior to the shower, the user removes the transit suit (if worn) and enters the shower with the respirator still operational and the filter unit still confined within the closed bag. Initial showering is performed to wash away contaminant material from the hair, hands etc., with the filter unit in the bag protected from damage by water. When the user is as clean as practicable, the respirator is removed, the face mask separately cleaned if necessary, and showering is completed. The user then passes downstream of the shower cubicle to put on normal clothing. The respirator, including the protected filter unit, is also taken downstream of the shower and the closed bag is left in place until the respirator is subsequently used. The respirator can be switched off without opening the bag, this being readily enabled by the flexible and generally transparent nature of the material of which the bag is made. The respirator is now safely transportable to a site at which the power supply is recharged and/or the filter elements are changed. It is possible, if desired, to provide the filter unit with a short extension lead having its end exiting and exposed just beneath the bottom of the bag, so that re-charging can be carried out also without removing the filter unit from the bag. As there is no cause not to take the respirator into the shower cubicle (as the filter unit is protected against water), there is equally no reason to remove the respirator upstream of the shower cubicle, for example to pass through a public transit area, which is known to create a health hazard.

BRIEF DESCRIPTION OF DRAWINGS

One embodiment of filter unit protection bag constituting an accessory device in accordance with the invention will now be described by way of example with reference to the accompanying drawings, in which.

DESCRIPTION OF EMBODIMENT

Figure 2:
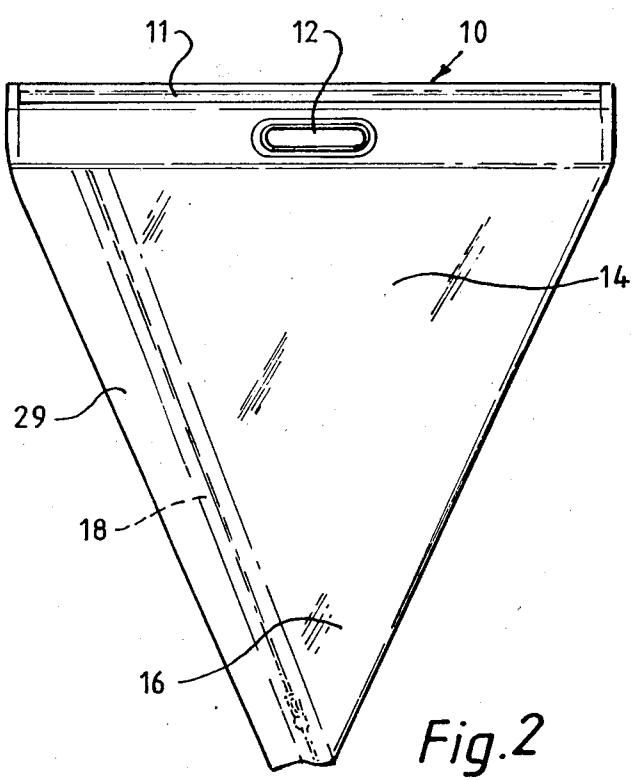
FIGS. 1 and 2 respectively show the flattened bag in diagrammatic elevation from the front and from the back.

The illustrated bag is of impervious flexible material such as relatively stiff semi-transparent sheet polythene. It is generally triangular in shape when flattened, and has a wide closed top 10, reinforced by a stiffening rod 11. It is provided with an integral handle 12. Below the top, the bag has a narrowing voluminous region 14, below which the bag further reduces in width to a narrow bottom end 16. A zip-type closure 18 extends from the bottom end to the closed top adjacent one inclined side edge of the triangle.

In a modification, the bottom of the voluminous region may narrow sharply to the top of the region of reducing width beneath it, thus tending to support a filter unit of a respirator without substantially stretching the bag material vertically in said voluminous region. It is alternatively possible to equip the interior of the bag with supporting lugs or the like for a filter unit. In the illustrated embodiment of triangular bag however, the reinforcement 11 along the top edge, where the handle 12 is provided, enables the bag substantially to retain its shape when the bag is being carried with a filter unit supported inside it.

The region 14 of the bag incorporates an air inlet valve 26 (one-way diaphragm valve) which, in addition to providing for ready access of air to the interior of the bag, serves the further purpose, assuming the filter unit to have been correctly inserted, of spacing the bag material from the filter unit intake. Externally, the intake to the valve 26 is protected by a flap or pocket 28 which prevents water entry through said valve. A side flap 29 serves to shield the zip-type fastener 18 for the same purpose. Clearly, it would be possible to provide the bag with an air intake valve separate from a spacer.

Figure 3:
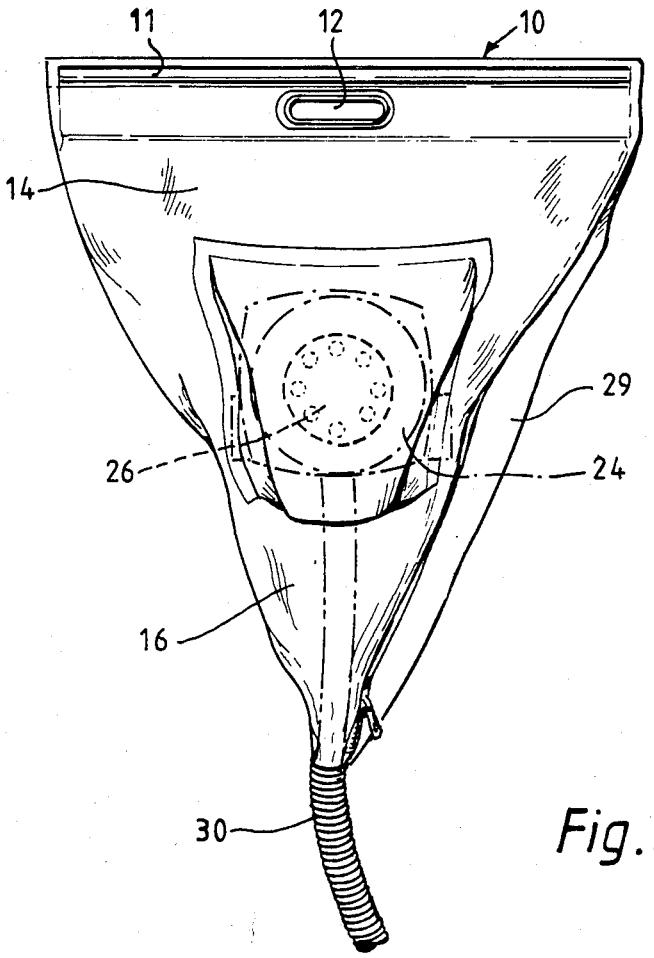
FIG. 3 shows the bag from the front when closed around a filter unit.

Referring to the drawing figures, particularly, FIG. 3, valve 26 includes an apertured rimmed front plate which is connected to an apertured rimmed back plate to form a shallow chamber in between in which is housed a disc or membrane which curved so as to bias it against an internal peripheral seat, thereby keeping the valve closed.

Figure 1:
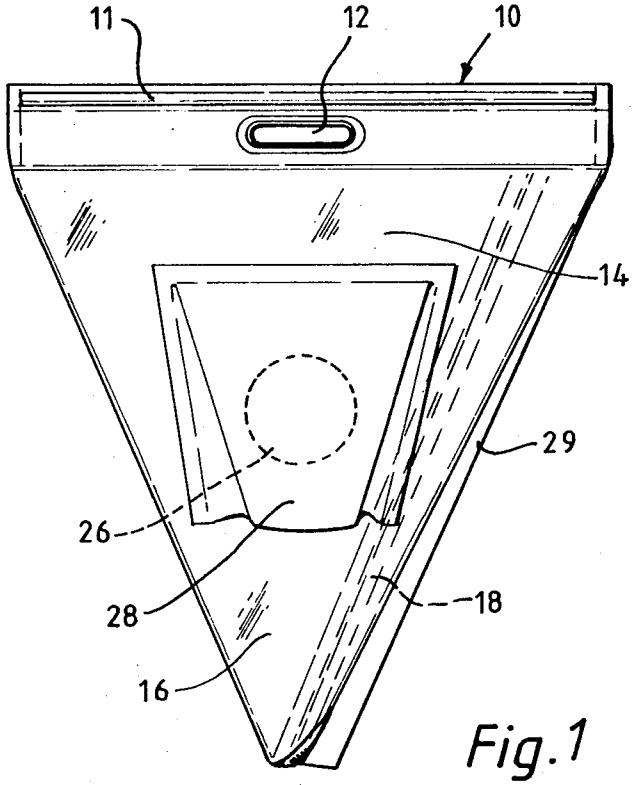

FIG. 3 further shows valve 26 as being located in the wall of the bag beneath the protective flap or pocket 28 (see, FIG. 1). If filter unit 24 is put inside the bag with its inlet against the rear face of the valve on the interior of the bag, then this will prevent the bag material from being sucked against filter unit 24 to block it. It is simply a case of positioning filter unit 24 correctly when it is placed into the bag.

When the bag is zipped closed around a filter unit 24, as shown in FIG. 3, it closes tightly around the respirator hose 30 at its bottom end, whilst loosely enclosing the filter unit 24 to enable the latter to continue to operate.

The illustrated bag is by way of example only and may be modified in various ways within the scope of the invention defined in the appended claims.

I claim:

1. An accessory device for safety breathing equipment, comprising a bag of flexible impervious material, narrowing from a wide closed top to a relatively narrow bottom end, said bag having means at the top by which it can be carried, a voluminous region below the top for accommodating the air filter unit of a respirator, a region of reducing width below said voluminous region for accommodating the hose or hoses leading towards the face mask of the respirator, and a means of closure extending from the bottom end to a point at or adjacent the closed top and which, when the bag is in use, closes the bag tightly around the hose or hoses extending out of its bottom end and loosely encloses the filter unit in the voluminous region, the arrangement also providing for air access to the interior of the bag for enabling continued operation of the filter unit when required.

2. A device according to claim 1, having a closure means constituted by a zip-type fastener.

3. A device according to claim 1, having a one-way valve for providing access of air to the voluminous region of the bag.

4. A device according to claim 1, wherein the bag is made of impervious, flexible and semi-transparent plastics material.

5. A device according to claim 1, wherein the bag is of a generally triangular shape, and incorporates a stiffening member along the closed top of the triangle.

6. A device according to claim 1, in combination with a filter unit supported in the voluminous region of the closed bag with at least one hose for coupling the filter unit to a face mask projecting from the narrowbottom end of the bag.

* * * * *